United States Patent [19]

Bascou

[11] 3,979,144

[45] Sept. 7, 1976

[54] LUGGAGE BOOT LID LOCK FOR MOTOR VEHICLE

[75] Inventor: Jacques Bascou, Boulogne-Billancourt,(Hauts de Seine, France

[73] Assignees: Regie Nationale des Usines Renault; Automobiles Peugeot, both of Paris, France

[22] Filed: Apr. 10, 1975

[21] Appl. No.: 566,702

[30] Foreign Application Priority Data

Apr. 11, 1974 France ..... 74.12833

[52] U.S. Cl. ..... 292/216; 70/240; 292/210

[51] Int. Cl.[2] ..... E05C 3/16

[58] Field of Search ..... 70/240; 292/DIG. 14, 292/DIG. 43, 216, 209, 210

[56] References Cited

UNITED STATES PATENTS

| | | | |
|---|---|---|---|
| 2,767,007 | 10/1956 | Burke | 292/216 |
| 2,877,039 | 3/1959 | Krause | 292/216 |
| 3,429,153 | 2/1969 | Magyar | 292/210 |
| 3,785,186 | 1/1974 | James et al. | 70/240 |

*Primary Examiner*—Roy D. Frazier
*Assistant Examiner*—Darrell Marquette
*Attorney, Agent, or Firm*—Fleit & Jacobson

[57] ABSTRACT

The invention relates to a lock for the hinged lid, panel or bonnet of a motor vehicle. Said lock comprises a locking hook pivoted to a support by means of a pivot pin, and a keeper coacting with said hook, said hook being urged to its open or release position by a torsion spring interposed between said hook and said support, and means for locking said hook in its closing or locking position in relation to said keeper, said locking means comprising on the one hand said spring reacting against said support by means of an arm having a certain freedom of movement as far as the distance between said arm and the hook axis is concerned, and on the other hand manual control means coacting with said spring arm for varying said distance between said arm and said hook axis, whereby said spring arm will coact according to its distance from said axis with either a stop member for locking said hook in its locking or closing position, or another stop member for retaining said hook in its opening or release position.

7 Claims, 5 Drawing Figures

LUGGAGE BOOT LID LOCK FOR MOTOR VEHICLE

This invention relates in general to locks and has specific reference to locks for the luggage boot lids and/or hinge doors or panels of motor vehicles, for example for locking the engine bonnet or the luggage compartment, this lock being of the so-called cock type, that is, wherein when the key lock has been operated in the lock opening or releasing direction, it is only necessary to remove the key having resumed its neutral introduction position by virtue of a return spring enclosed in the lock barrel, the automatic re-locking function being subsequently obtained by simply slamming the bonnet or hinged lid equipped with this lock.

A conventional cock lock comprises as a rule:

a. a locking hook pivoted to a pin, and a spring constantly urging said locking hook to its open position and, in certain case, to act as an ejector for the bonnet or panel;

b. a stop hook pivoted to a pin and holding the locking hook in its open position.

It is the essential object of the present invention to provide a lock of the type broadly set forth hereinabove which simplifies considerably the existing system by eliminating the stop hook and its pivot pin, thus reducing the cost and over-all dimensions of the lock.

Basically, the lock according to this invention comprises a locking hook pivoted to a support by means of a pivot pin, and a keeper coacting with said hook, said hook being urged to its open or release position by a torsion spring interposed between said hook and said support, and means for locking said hook in its closing or locking position in relation to said keeper, said locking means comprising on the one hand said spring reacting against said support by means of an arm having a certain freedom of movement as far as the distance between said arm and the hook axis is concerned, and on the other hand manual control means coacting with said spring arm for varying said distance between said arm and said hook axis, whereby said spring arm will coact according to its distance from said axis with either a stop member for locking said hook in its locking or closing position, or another stop member for retaining said hook in its opening or release position.

In this construction, the operative connections between the manual control means and the lock proper is such that the lock can be adjusted in all directions, so that the use of an adjustable keeper can be avoided, the actual keeper consisting in this case simply of a welded reinforcing sheet metal member, which is a more economical especially from the stand point of mass production.

A typical form of embodiment of a lock according to this invention will now be described by way of example with reference to the attached drawing, in which.

Figure 1:
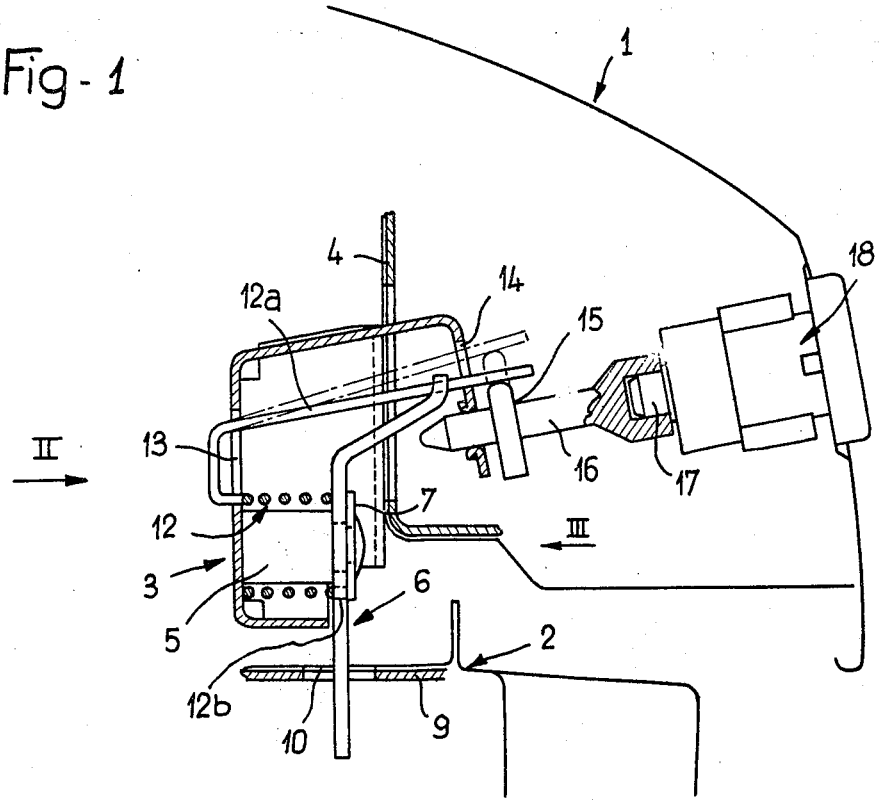
FIG. 1 is a side elevational and sectional view of the lock according to the present invention, which is mounted for locking the lid of a luggage boot, the section being taken along a vertical plane containing the axis of the retaining hook.
Figure 2:
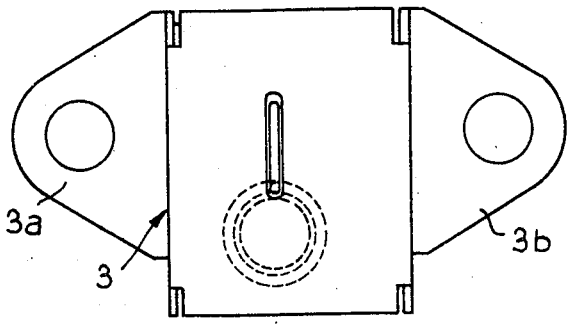
FIG. 2 is a view of the same lock as seen from the rear, i.e. in the direction of the arrow II of FIG. 1.

The lock illustrated in the drawing controls the locking of the rear hinged lid 1 of a luggage boot or compartment of a motor vehicle, of which the fixed boot portion is designated by the reference numeral 2.

This lock comprises a support 3 of bent pressed sheetmetal, formed with a pair of lateral lugs 3*a* and 3*b* for securing said support to an inner upstanding wing 4 of the lid 1. This support 3 constitutes a kind of half-case to which a stub shaft 5 is rigidly secured at one end the other end of stub shaft 5 has pivotally mounted thereon a locking hook 6. In this example, the hook 6 is pivoted to a portion of reduced diameter of said shaft 5, and retained thereon by a washer 7 held in turn on said shaft by riveting the reduced shaft end thereon. This hook 6 has formed integrally therewith at its lower end a locking beak 8 adapted to engage a keeper 9 consisting according to this invention of a reinforcing sheet metal member welded to the fixed wall of the luggage compartment 2, this assembly comprising an aperture 10 through which the locking beak 8 is adapted to project. This beak 8 also comprises an intermediate nose 11 extending somewhat like the beak 8 but slightly longer so as to act as a cam member and permit the pivotal movement of said beak 8 by engaging the keeper 9 during the lid closing movement.

The hook 6 is constantly urged to its lid opening position by a coil torsion spring 12 wound on the stub shaft 5, the end arms 12*a* and 12*b* of this spring engaging the support 3 and one edge of said hook 6, respectively. The first-mentioned arm 12*a* engages a pair of aligned vertical slots 13 and 14 of said support 3 with a certain degree of freedom as far as the distance between said arm 12*a* and the pivot axis of hook 6 is concerned. The free end of this arm 12*a* is adapted to coact with manually controlled lock release means consisting in this example of a cam 15 rigid with a shaft 16 rotatably mounted in said support 3 and connected through matching coupling means to the bolt or driving member 17 of a conventional safety cylinder lock 18 operable by means of a key rotating a half-turn in one or the other direction, resilient means being incorporated in this cylinder lock 18 for returning the key to its neutral position in which it can be inserted into and removed from the lock, according to a well-known arrangement.

Thus, operating said cam 15 will permit of varying the distance from said spring arm 12*a* to the axis of hook 6 and stub shaft 5, according to the two permissible positions shown in thick lines and dash-and-dot lines, respectively, in FIG. 1.

Figure 4:
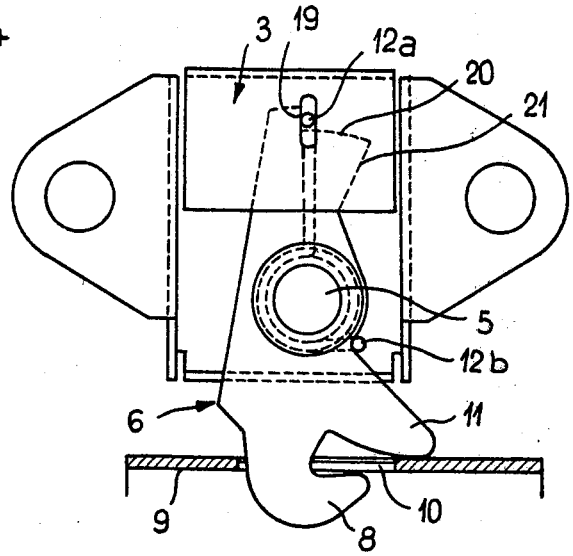
FIG. 4 is a view similar to the preceding one but showing the lock in its open or release position.

The position of the spring arm 12*a* shown in dash-and-dot lines in FIG. 1 corresponds to the lid opening position of the lock, as shown in FIG. 4, wherein this arm 12*a* is engaged by a stop member 19 adapted to position the hook 6 in its opening position. The spring 12 may in addition have a force sufficient to be capable of ejecting the lid 1 as shown in FIG. 4, i.e. slightly raising or holding this lid ajar, due to the bearing engagement between the intermediate nose 11 and the keeper 9.

In this lock opening position the return of the cylinder lock 18 to its neutral position which follows the opening maneuver performed by means of the key will move the cam 15 to the position permitting the resilient return of spring arm 12*a* to its thick-line position shown in FIG. 1, without changing the condition illustrated in FIG. 4.

Figure 3:
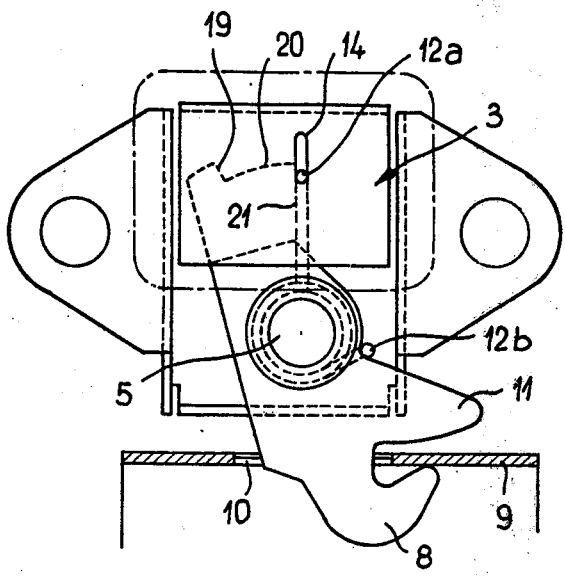
FIG. 3 is another view of the lock but as seen in the direction of the arrow III of FIG. 1.
Figure 5:
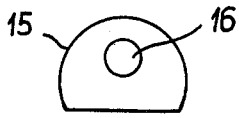
FIG. 5 is a detail view of the control cam.

However, from this condition to close the lid 1 in its locked position, it is only necessary to slam the lid. During this movement, the intermediate nose 11 coacts firstly with the keeper 9 in order to cause the locking beak 8 of hook 6 to pivot to the position shown in FIG. 3, while the corresponding angular movement of said hook causes a circular cam portion 20 thereof to retract past the arm 12*a*, whereby said arm 12*a* can resume its position of engagement with the bottom of the slot 14, as shown in thick lines, and one side of stop member 21 of hook 6 coacts with the aforesaid arm 12*a* which acts as a means for locking the hook 6 in its closing position as illustrated in FIG. 3.

It will be noted that from a manufacturing standpoint the cylinder lock 18 can be attached permanently to the lid 1 and the keeper 9 may likewise constitute a permanent element of the boot wall 2; the lock can be adjusted by simply modifying the fastening of support 3, for example by providing a certain degree of freedom for the manual control means 15, 16, 17 to compensate possible differences due to manufacturing tolerances.

Although a specific form of embodiment of this invention has been described hereinabove and illustrated in the accompanying drawing, it will readily occur to those skilled in the art that various modifications and changes may be brought thereto without departing from the scope of the invention as set forth in the appended claims.

What is claimed as new is:

1. A lock comprising, in combination, a support, a pivot pin mounted on said support, a keeper, a locking hook pivotally mounted on said pivot pin for pivotal movement between a locking position in locking engagement with said keeper and an unlocking position, a pair of stop members on said hook, a spring for yieldingly urging said hook pivotally in one direction, said spring having an arm arranged for limited flexible movement on said support towards and away from said pivot pin, manual control means engageable with said spring arm for moving said spring arm flexibly a selected distance with respect to said pivot pin, said spring arm being movable into one position for engagement with one of said stop members on said hook to maintain said hook in said unlocking position and said spring arm being movable into a second position for engagement with the other of said stop members to maintain said hook in said locking position.

2. A lock in accordance with claim 1 wherein said support is provided with a pair of spaced-apart slots and wherein said spring arm extends within said slots, said spring arm being engageable with said hook stop members intermediate said slots.

3. A lock in accordance with claim 1 wherein said manual control means includes a cylinder lock having a driving bolt and a cam on said driving bolt engageable with said spring arm to provide said flexible movement of said spring arm towards and away from said pivot pin.

4. A lock as set forth in claim 1 wherein said hook is provided with a circular cam portion intermediate said stop members and wherein said spring arm is normally urged resiliently against said circular cam portion.

5. A lock in accordance with claim 1 including a pivotally movable lid, means for mounting said support on said lid, said hook including a beak portion for engagement with said keeper in said locking position of said hook and an intermediate nose portion on said hook for engagement with said keeper in a closing position of the lid to produce a pivotal movement of said hook for locking engagement of said beak portion with said keeper, said nose portion being arranged to move said lid to a limited extent out of the lid closing position in said hook locking position by the urging force of said spring in said one direction.

6. A lock in accordance with claim 3 including two closing elements arranged for relative movement and wherein said cylinder lock is mounted on one of said closure elements and wherein said keeper is mounted on the other of said closing elements and including means for adjustably mounting said support in a selected position on one of said closing elements.

7. A lock in accordance with claim 6 wherein said keeper comprises a sheet metal member secured to one of said closing elements, said keeper having an aperture for receiving said hook and for retaining said hook in said locking position.

* * * * *